US005850705A

United States Patent [19]

Groh

[11] Patent Number: 5,850,705

[45] Date of Patent: Dec. 22, 1998

[54] CIRCUIT DIRECTORY FOR ELECTRIC PANELS

[76] Inventor: David S. Groh, 2412 Ridge Rd., Elverson, Pa. 19520

[21] Appl. No.: 739,730

[22] Filed: Nov. 7, 1996

Related U.S. Application Data

[60] Provisional application No. 60/006,511 Nov. 9, 1995.

[51] Int. Cl. [6] ..... G09F 1/10

[52] U.S. Cl. ..... 40/124.2; 40/405; 40/654.01; 40/594

[58] Field of Search ..... 40/124.2, 405, 40/654.01, 657, 661, 765, 775, 776, 594; 402/79, 80 P; 434/379, 429, 430

[56] References Cited

U.S. PATENT DOCUMENTS

| | | | |
|---|---|---|---|
| 2,871,153 | 1/1959 | Copen | 40/776 X |
| 3,091,046 | 5/1963 | Engelstein | 40/776 X |
| 3,959,903 | 6/1976 | Shneider . | |
| 4,365,433 | 12/1982 | Buell | 40/124.2 X |
| 4,599,815 | 7/1986 | Waldo . | |
| 4,670,076 | 6/1987 | Daries . | |
| 4,704,042 | 11/1987 | Eisen et al. | 40/776 X |
| 4,706,396 | 11/1987 | Nomura | 40/124.2 |
| 4,756,106 | 7/1988 | Foster | 40/594 X |
| 4,824,273 | 4/1989 | Silva et al. | 402/79 |
| 4,827,641 | 5/1989 | Mori . | |
| 4,899,879 | 2/1990 | Rosen | 40/776 X |
| 4,918,848 | 4/1990 | Stein | 40/124.2 X |
| 4,965,948 | 10/1990 | Ruebens . | |

*Primary Examiner*—Brian K. Green
*Attorney, Agent, or Firm*—Richard C. Litman

[57] ABSTRACT

A system is disclosed for displaying the directory information of electrical panels. The system includes a support panel which is secured in a location proximate the electrical panel. A cover is secured to the front surface of the support panel in such a manner as to create a pocket between the cover and the support panel. The pocket receives a service card for recording the service history of the electrical panel. A plurality of sleeves are attached to the support panel in a staggered arrangement. Each sleeve receives a circuit card which contains information specific to predetermined circuit breaker. Each circuit card also includes indicia thereon for identifying it with the predetermined circuit breaker. The system may also be provided with a computer program for storing and managing information pertaining to the circuit breakers of the electrical panel. The program may also be used to print circuit cards.

8 Claims, 4 Drawing Sheets

CIRCUIT DIRECTORY FOR ELECTRIC PANELS

CROSS REFERENCE TO RELATED APPLICATION

This application is based on Provisional patent application Ser. No. 60/006,511, filed Nov. 9, 1995.

BACKGROUND OF THE INVENTION

1. Field of the Invention

The present invention relates to informational directories and more particularly to an informational directory for electrical panels. The invention is specifically related to a flip file directory system for providing complete circuit information for circuit breaker panels.

2. Description of the Prior Art

Directories for circuit breaker panels are well known in the art for providing a user with adequate information regarding electrical layout and control of specific locations. Typically a directory is disposed within the housing for the circuit breaker panel. While such directories provide certain information relating to the control functions of individual circuit breakers, most users are incapable of determining which circuit breakers control specific areas. This is due substantially to space restrictions and the substandard manner in which these directories are organized.

There are various well known methods of protectively displaying records and other forms of data, such flip files. Conventional flip files include a series of transparent pockets which are staggered on a base card. Each pocket is capable of receiving a record or data item. The pockets are hinged to the base card such that each may be raised or flipped upward to expose subsequent pockets. Traditional practice has been to use such flip files in conjunction with the storage of photographs and business records.

Presently, there exists no system for displaying a comprehensive directory of circuit breaker panels in a manner which allows a user to quickly and efficiently determine the control function of individual circuit breakers. The prior art discloses numerous storage systems, however most are suited for use with photographs and business cards. For example, U.S. Pat. No. 3,091,046 issued on May 28, 1963 to Engelstein discloses a flip file card system having envelopes in a staggered relation. Each envelope is formed by two superposed transparent panels which are joined at their ends. A strip is interposed between the two panels in a parallel relationship and joined by a spacer rib to the underside of the upper panel to provide a ledge for supporting the lower margins of a picture insert. An index strip is also provided for insertion in the envelopes.

U.S. Pat. No. 3,959,903 issued on Jun. 1, 1976 to Schneider discloses a protector for rotary display stands. The apparatus includes a display stand which contains a horizontally-rotatable group of pockets which open at the top and are carried by a vertical spindle. A plastic sheet is used to cover the pockets in order to keep dust from falling therein. The plastic sheet is also perforated in order to allow passage for the spindle. When the stand is tilted to position the spindle horizontally, the sheet assumes the position of a side closure for the pockets, thus preventing their contents from falling out.

U.S. Pat. No. 4,599,815 issued on Jul. 15, 1986 to Waldo discloses a photography display wheel made up of a spindle having annular tracks and stand supports for a spindle to spin on. A ratchet type control member is positioned a one end of the spindle in order to limit the rotation thereof to one direction. Thus, when protective jackets with enclosed photographs may be mounted on the annular track of the spindle such that they are free to turn in one direction so as to facilitate viewing on the spindle.

U.S. Pat. No. 4,670,076 issued on Jun. 2, 1987 to Daries discloses a method for fabricating a visible file pocket support panel for use in supporting any number of pockets having front, back, upper, and lower pocket tips. The pocket tips are coextensive with the upper and lower edges of the file pocket. A hinge pin extends transversely through the file pocket adjacent the upper edge and projects laterally beyond both sides of the file pocket with hinge elements mounted on the projecting ends thereof.

U.S. Pat. No. 4,827,641 issued on May 9, 1989 to Mort discloses an index device having a cover member which is axially attached to a receptacle so as to be openable and closeable. A multiplicity of cards are accommodated between the cover member and the receptacle so as to be superposed on each other. The indexing device is arranged such that a rotation resisting member including a resilient substance is provided between the receptacle and the cover member. The rotation resisting member has a rotor which rotates within hermetically sealed casings attached to the receptacle and filled with a viscous substance. The rotor further includes notches formed in a peripheral portion thereof.

U.S. Pat. No. 4,965,948 issued on Oct. 30, 1990 to Ruebens shows a bi-directional album with memo area. The album is suited for the storage of photographs and the like in either a latitudinal or longitudinal vertical orientation. Each page of an album leaf is partially covered by a transparent sheet attached along several of its edges to a leaf page. Additional lines of attachment between the transparent sheet and the leaf page are disposed and oriented so as to permit horizontal storage of photographs between the attachment lines. Photographs can also be stored in a vertical orientation under the sheet adjacent the storage lines.

None of the above inventions and patents, taken either singly or in combination, is seen to describe the instant invention as claimed.

SUMMARY OF THE INVENTION

Accordingly, it is a principal object of the invention to provide as system for displaying directory information for electrical panels.

It is another object of the invention to provide a system for quickly displaying control information for each individual circuit breaker.

It is a further object of the invention to provide a system which allows appropriate personnel to record service information pertaining to an electrical panel.

It is a still further object of the invention to provided a system which incorporates a general purpose computer to manage information regarding electrical panels.

It is an object of the invention to provide improved elements and arrangements thereof in an apparatus for the purposes described which is inexpensive, dependable and fully effective in accomplishing its intended purposes.

In accordance with the objects of the invention, a system is provided for displaying the directory information of electrical panels. The system includes a support panel which has a front surface and a rear surface. The support panel may be secured to a plurality of location including a surface of the housing containing the electrical panel. In preferred embodiments of the invention, adhesive strips are used to secure the support panel to a mounting location. A cover is secured to the front surface of the support panel in such a manner as to create a pocket between the cover and the support panel. The pocket is used to store a service card for recording the service history of the electrical panel. The pocket may also be used to store advertisements, update reminders, or new legal regulations which apply to electrical panels. A plurality of sleeves are attached to the support panel in a staggered arrangement. The sleeves are attached such that they may be flipped upward in order to view the rear side of the circuit card. Each sleeve contains an aperture therein for receiving a circuit card which contains information specific to a predetermined circuit breaker. In preferred embodiments of the invention, the apertures in the sleeves are positioned such that they may only be accessed by lifting the sleeve in such a manner as if to view the rear of the circuit card. Thus, dust and other contaminants will be unable to settle within the sleeve. Each circuit card also includes indicia thereon for identifying it with the predetermined circuit breaker. Additional sleeves may be provided for receiving instructional or otherwise pertinent cards relating to the operation of the system.

In accordance with another object of the invention, a system is provided for managing information pertaining to the directory of an electrical panel. The system includes a general purpose computer for executing a program. The program creates a graphical interface which allows a user to simulate a physical circuit directory on a display device and manipulate related information. The program utilizes a plurality of menus and buttons for allowing the user to create records, edit records, associate records into groups, and locate specific records. The program also allows the user to print information for use with the physical circuit directory.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
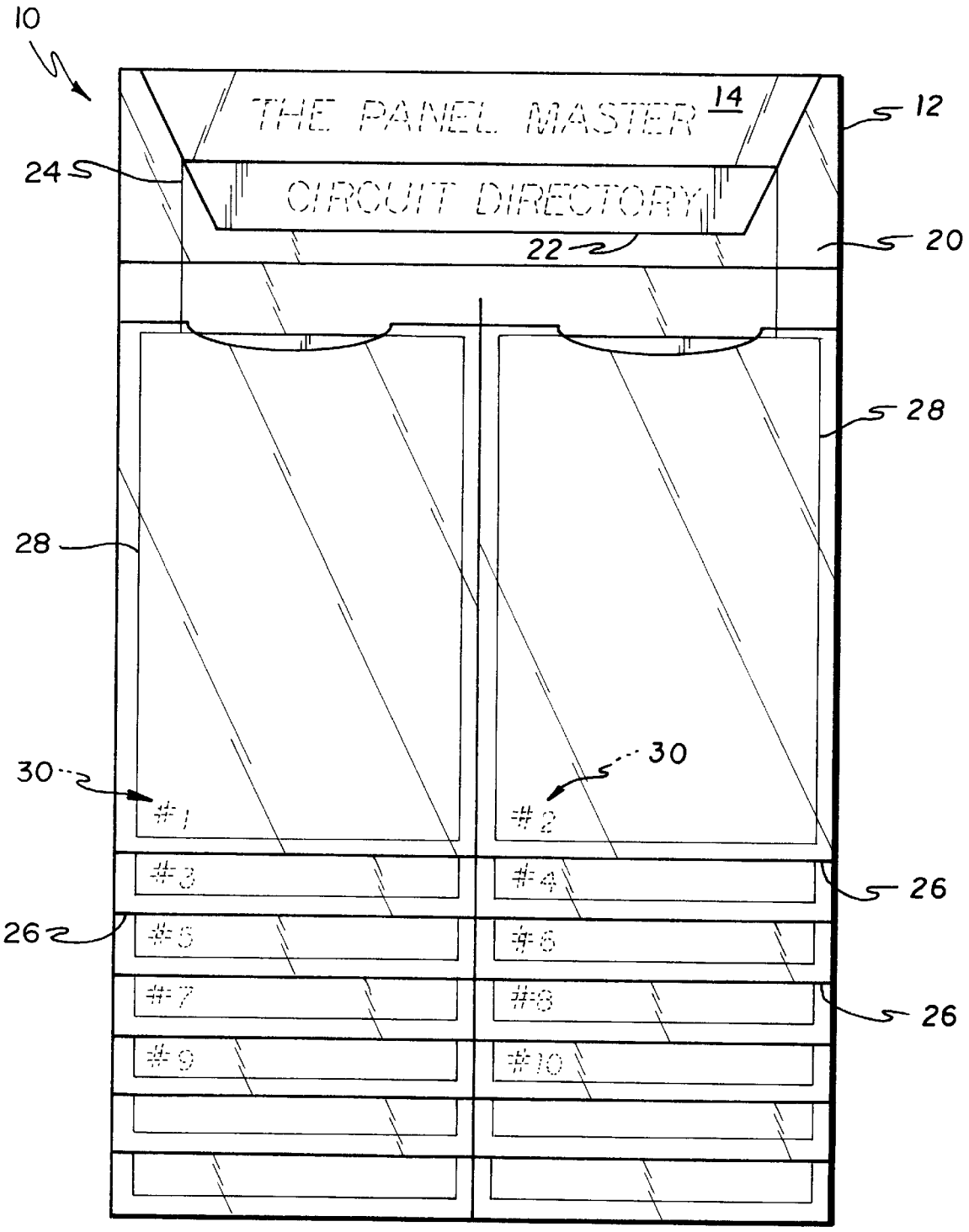
FIG. 1 is a front elevational view of a circuit directory in accordance with the present invention.
Figure 2:
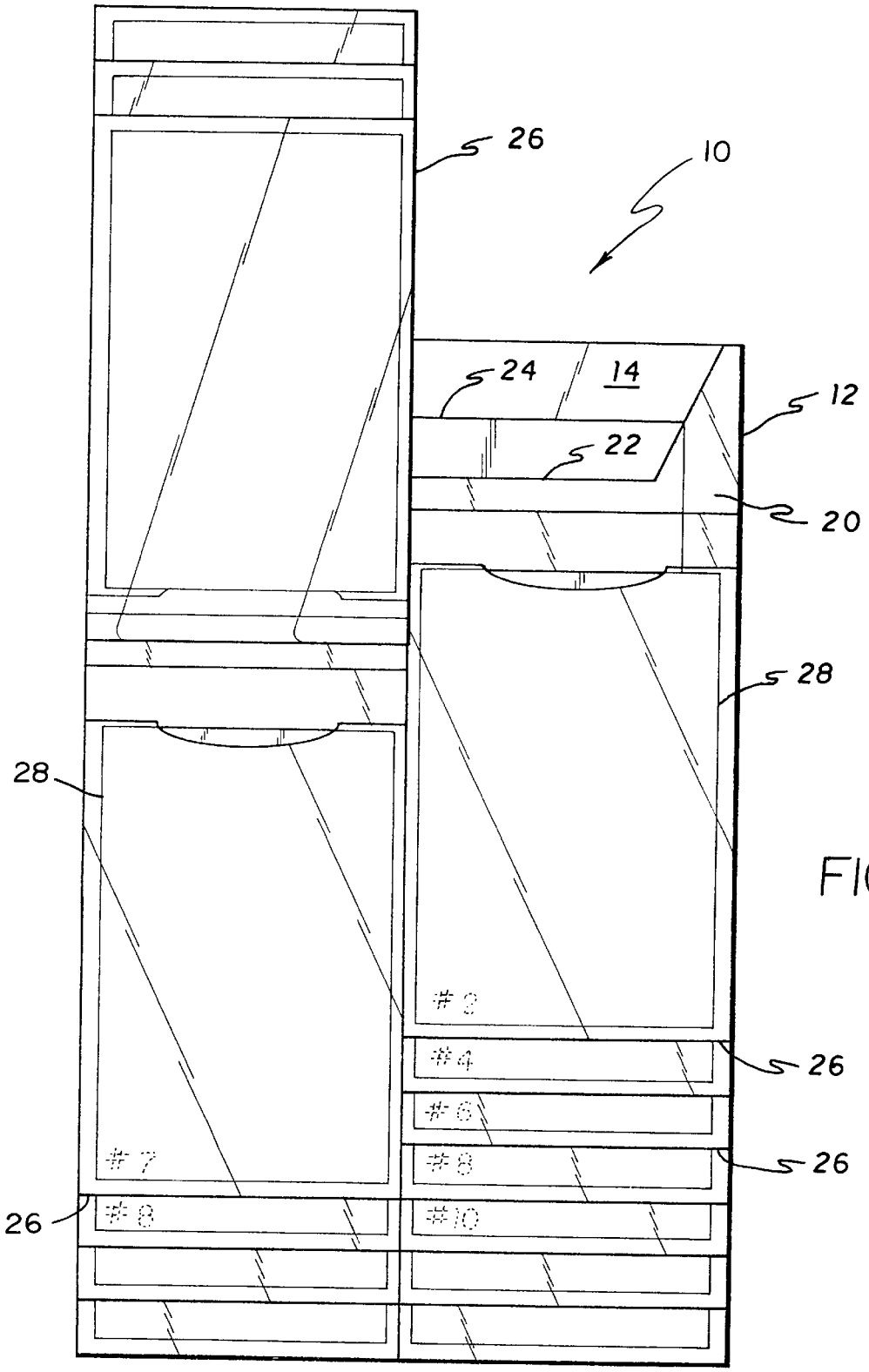
FIG. 2 is a front elevational view illustrating the accessibility of each sleeve.
Figure 3:
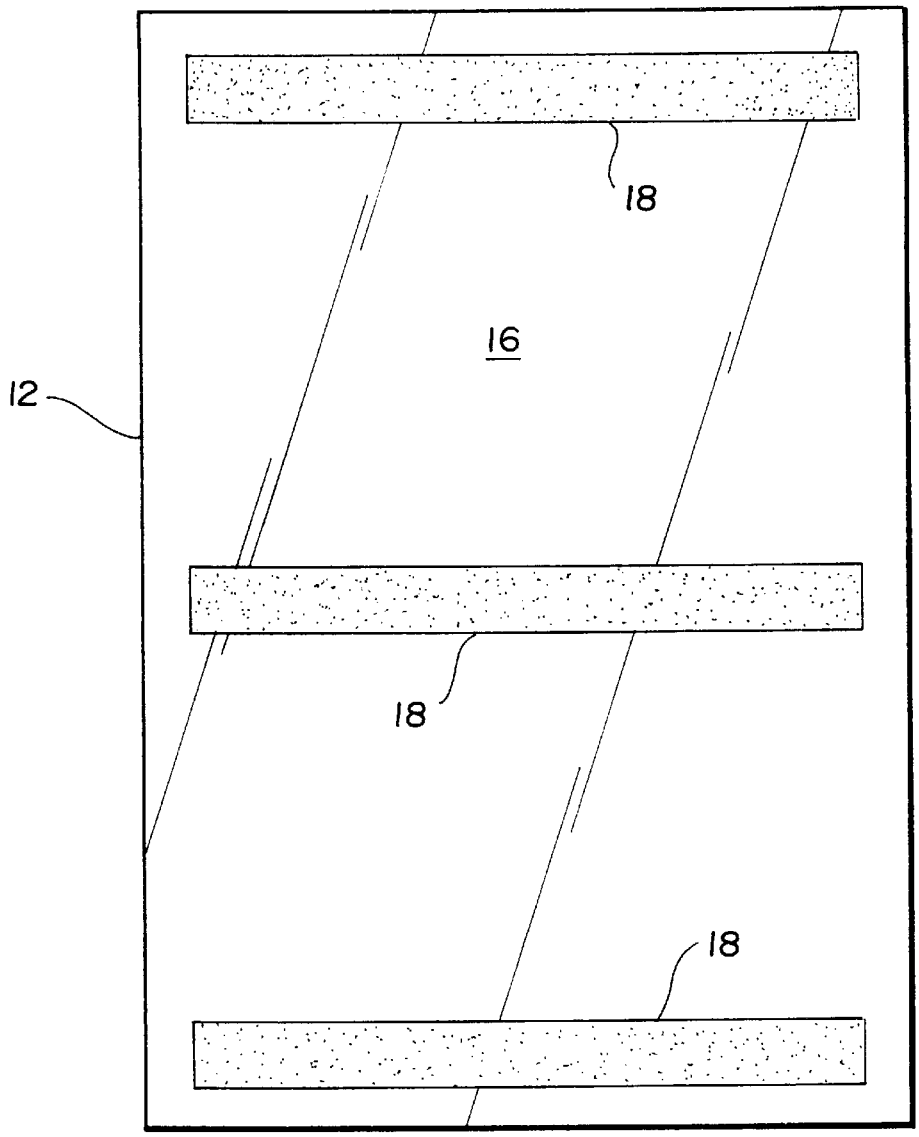
FIG. 3 is a rear elevational view of the support panel used in the present invention.

With reference to the drawings and initially to FIGS. 1 and 2, a system 10 is shown for displaying directory information pertaining to an electrical panel. The system 10 may also be used to store other forms of information such as the ingredients in various meals, circuit information for a motor control center, or as a quick reference to the telephone extensions of personnel in various departments of a large office. The system 10 includes a support panel 12 which has a front surface 14 and a rear surface 16. The support panel 12 may be a rigid or flexible member and may be constructed of various lightweight materials such as plastic. The support panel 12 is then mounted to a location proximate the electrical panel. In preferred embodiments of the invention, the support panel 12 is secured to the housing containing the electrical panel. Various methods exist for securing the support panel 12, including adhesive strips 18 disposed on its rear surface 16, as illustrated in FIG. 3. The support panel 12 may also include an adhesive backing disposed on the entirety of its rear surface 16.

Turning back to FIG. 1, a cover 20 is shown secured to the front surface 14 of the support panel 12 in such a manner as to create a pocket therebetween. The cover 20 is composed of clear materials such as plastic or vinyl. The pocket has an opening 22 near the uppermost portion of the support panel 12 and is used to store a service card 24. The service card 24 is used by service personnel to record the service history or renovation history of the electrical panel. The pocket may also be used to store various other materials such as advertisements, update reminders, or new legal regulations which apply to electrical panels. A plurality of sleeves 26 are attached to the support panel in a staggered arrangement. The sleeves 26 can be attached in a plurality of ways including gluing and welding. The sleeves 26 may be further divided into a dual column staggered disposition, as seen in FIG. 1, in order to accommodate the necessary number of circuit breakers contained in the electrical panel. Each sleeve 26 includes an aperture for receiving a circuit card 28. Each circuit card 28 corresponds to a predetermined circuit breaker. Each circuit card 28 contains an indicia 30 positioned at the lower portion thereof for identifying its relationship to a particular circuit breaker. The indicia 30 allows quick and efficient access to information regarding a specific circuit breaker. Accordingly, each circuit card 28 contains all of the electrical and circuit information regarding its corresponding circuit breaker. In preferred embodiments of the invention, the first two sleeves 26 are reserved for receiving general information on the electrical panel and the business card of the contractor who serviced the electrical panel.

As seen in FIG. 2, the sleeves 26 are attached such that they may be flipped upward in order to view the rear side of the circuit card 28. The rear side of the circuit card 28 may be used to enter notes or cautions regarding its associated circuit breaker. Therefore, each circuit card 28 may include information on the front and rear surface. In preferred embodiments of the invention, the apertures in the sleeves 26 are positioned such that they may only be accessed by lifting the sleeve 26 as if to view the rear of the circuit card 28. Thus, dust and other contaminants will be unable to settle within the sleeve 26. The system may include additional sleeves 26 which do not correspond to a circuit breaker. Such sleeve 26 are suited for receiving instructional cards relating to the operation of the system or miscellaneous cards.

The system 10 may also be provided with a general purpose computer for storing and modifying information pertaining to the circuit cards 28. Such a computer would include a CPU, a display unit, data storage and retrieval devices, a keyboard, and selection devices such as a mouse. The computer functions in a manner generally similar to the system 10 and recreates a display which simulates a physical view of the system 10. The computer is used to execute a program which utilizes a plurality of menus and buttons to allow the user to create records, edit records, associate records into groups, and locate specific records. In order to display a particular circuit card 28, the user would simply select the proper sleeve 26 on the display unit using the mouse. Once the circuit card 28 is displayed, information may be added or deleted therefrom. The circuit card 28 may be printed immediately using the included printer and subsequently placed in the appropriate sleeve 26. The computer allows the circuit cards 28 of the system 10 to be easily updated and maintained. The computer is especially suited for use with large industrial and commercial establishments who may need to maintain multiple electrical panels.

Figure 4:
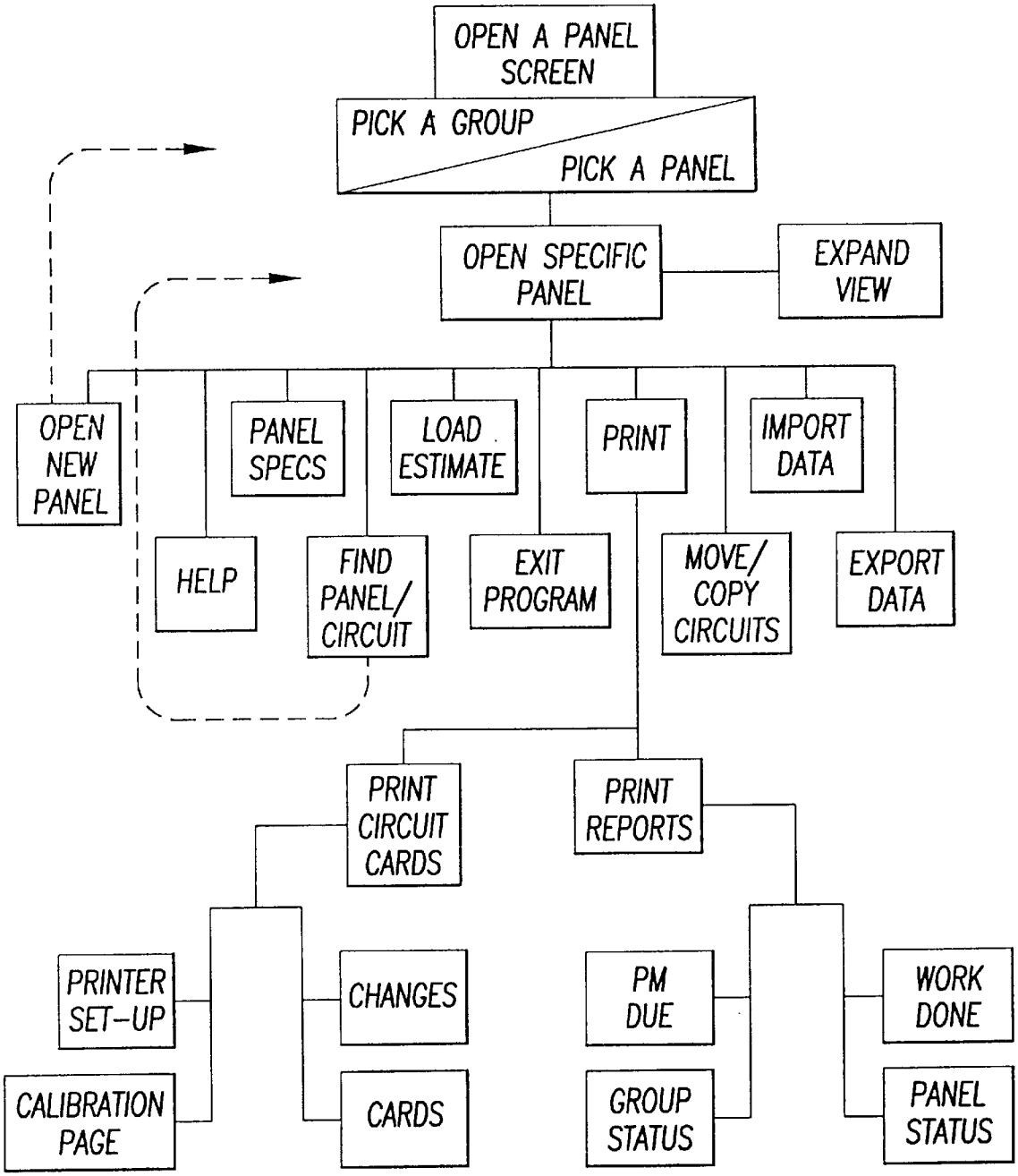
FIG. 4 is a flow chart illustrating operation of a computer program for use with the system.

FIG. 4 shows a flow diagram which illustrates operation of the program. The program creates a graphical interface which allows a user to simulate a physical circuit directory on a display device and manipulate related information. When the program is executed, the user may open a predefined group or a specific electrical panel. If the user opens a group, a subsequent menu will allow selection of a specific electrical panel. Once a specific electrical panel is selected, the user may examine the specifications of electrical panel or select specific circuit breakers and enter various information relating thereto. For example, breaker types, devices controlled by the circuit breaker, etc. Once all of the information pertaining to the electrical panel has been entered, the program is capable of generating load estimates pertaining to the electrical panel. The user may also enter relevant information such as the service record of particular service breakers or devices which are electrically controlled by the circuit breaker. The program also allows a user to schedule maintenance on individual service breakers. If the service date is past due, the user is provided with a visual indication prior to selection of specific circuit breakers. Thus the user is immediately aware of the location and quantity of circuit breakers requiring service. The user may then select one such breaker and examine the service history in order to determine the date when service should have been performed. In editing and creating new circuit breaker information, the user may import and export information from and to various other electrical panels. The user may also generate and print reports corresponding to activities on an electrical panel or a group. For example, the user may generate a report indicating which circuit breakers have past maintenance (PM) due dates, or which circuit breakers have recently had work done and what the work was. Once the user has completed editing the information pertaining to a particular circuit breaker, the information can be printed in the form of a circuit card 28. The circuit card 28 may then be inserted into the appropriate sleeve 26 on the support panel 12.

It is to be understood that the present invention is not limited to the sole embodiment described above, but encompasses any and all embodiments within the scope of the following claims.

I claim:

1. A system for displaying a directory of an electrical panel contained in a housing and having a plurality of circuit breakers disposed thereon, the system comprising:

a. a support panel including a top edge, a front surface and a rear surface;

b. an adhesive backing disposed on the rear surface for mounting the support panel to the housing of the electrical panel;

c. a transparent cover having a generally similar size and shape as said support panel, said cover being secured to the front surface of said support panel in such a manner as to create a pocket formed therebetween, said pocket having a generally similar size and shape as said support panel and having an opening proximate the top edge of said support panel;

d. a plurality of circuit cards having a front surface and a back surface containing control information for said circuit breakers on said front surface; and e. a plurality of sleeves, each smaller in size than said pocket and having a top edge and an aperture proximate the top edge for receiving each of said circuit cards, wherein said sleeves are attached to said support panel in a staggered manner and protectively display said circuit cards.

2. A system for displaying the directory of an electrical panel as recited in claim 1 further comprising a service card disposed in said pocket for recording information pertaining to the service history of said electrical panel.

3. A system for displaying the directory of an electrical panel as recited in claim 1 wherein each of said circuit cards further includes space on the back surface for entering notes regarding its associated circuit breaker.

4. A system for displaying the directory of an electrical panel as recited in claim 1 wherein each of said circuit cards includes indicia on the front surface corresponding to a circuit breaker disposed in said electrical panel.

5. A system for displaying the directory of an electrical panel as recited in claim 1 wherein said adhesive backing comprises a plurality of adhesive strips.

6. A system for displaying the directory of an electrical panel as recited in claim 5 further comprising a plurality of help cards disposed in a predetermined number of sleeves.

7. A system for displaying the directory of an electrical panel as recited in claim 6 further comprising computer means for electronically storing control information pertaining to said circuit breakers.

8. A system for displaying the directory of an electrical panel as recited in claim 7 wherein said computer means includes means for storing control information for a plurality of electrical panels.

* * * * *